US005519217A

United States Patent [19]

Wilbur, Jr. et al.

[11] Patent Number: 5,519,217

[45] Date of Patent: May 21, 1996

[54] APPARATUS FOR CHARGING AN ORGANIC PHOTOCONDUCTIVE LAYER FOR A CRT

[75] Inventors: Leonard P. Wilbur, Jr., Lancaster; Owen H. Roberts, Jr., Landisville, both of Pa.

[73] Assignee: Thomson Consumer Electronics, Inc., Indianapolis, Ind.

[21] Appl. No.: 436,507

[22] Filed: May 8, 1995

[51] Int. Cl.[6] ..... G03G 15/02

[52] U.S. Cl. ..... 250/326; 445/50; 430/23

[58] Field of Search ..... 250/326, 324, 250/325; 455/36, 45, 52, 58; 430/23, 28; 354/1; 361/225, 229, 230, 233; 313/364

[56] References Cited

U.S. PATENT DOCUMENTS

| | | | |
|---|---|---|---|
| 4,047,238 | 9/1977 | Moraw | 250/326 |
| 4,646,196 | 2/1987 | Reale | 361/230 |
| 4,725,731 | 2/1988 | Lang | 250/326 |
| 4,841,146 | 6/1989 | Gundlach et al. | 250/324 |
| 5,083,959 | 1/1992 | Datta et al. | 445/52 |
| 5,324,942 | 6/1994 | Mishra et al. | 250/326 |

*Primary Examiner*—Jack I. Berman
*Assistant Examiner*—Kiet T. Nguyen
*Attorney, Agent, or Firm*—Joseph S. Tripoli; Dennis H. Irlbeck; Vincent J. Coughlin, Jr.

[57] ABSTRACT

An apparatus (38) for rapidly and uniformly electrostatically charging a photoconductive layer (34) disposed on a conductive layer (32) provided on an interior concave surface of a viewing faceplate (18) of a CRT faceplate panel (12) is disclosed. The apparatus includes a housing (40) having a faceplate panel support surface (42), an electrical contact (52) for grounding the conductive layer, a corona charger (48), and power supplies (200, 204) for corona charging. The corona charger (48) includes a charging head (46) that substantially conforms to the contour of the interior concave surface of the viewing faceplate (18). The charging head comprises a base plate (54) having a mounting surface (56) to which a plurality of discrete charging modules (82) are attached. Each of the charging modules includes a focusing blade (86) and a charging blade (88, 188) insulated from the focusing blade. An ultimate focusing blade (186) is attached to the ultimate discrete charging module. The dimensions of the charging head are slightly less than the interior dimensions of the faceplate panel. The first power supply applies a first voltage to each of the charging blades and a second power supply applies a second voltage to each of the focusing blades. The apparatus further includes a motor (210) with an eccentric cam (212) that is connected by a shaft (214) to the charging head for laterally moving the charging head within the faceplate panel for a distance substantially equal to the periodic spacing (P) between charging blades of adjacent discrete charging modules, thereby providing a substantially uniform electrostatic charge to the photoconductive layer on the viewing faceplate.

23 Claims, 9 Drawing Sheets

12
23
18
48
32
34
P
A
82
82
82
23
20
102
88
86
86
86
134
148
88
186
88
32
142
52
138
146
140
90
123
92
122
128
104
94
104
50
56
54
58
84
128
132
84
84
43
44
202

90
92
108
110
112
114
116
118
120
133
134
136
131
148
12
E
D
I
J
K
L
M
F
G
H
$r_1$
$r_2$

R
Q
T
S
V
U
$r_3$
$r_4$
88
150
152
154
156
18
188
20
250
252
254

APPARATUS FOR CHARGING AN ORGANIC PHOTOCONDUCTIVE LAYER FOR A CRT

The invention relates to an apparatus for charging an organic photoconductive (OPC) layer on an interior concave surface of a viewing faceplate of a color cathoderay tube (CRT) and, more particularly to an apparatus for uniformly and expediently charging the OPC layer.

BACKGROUND OF THE INVENTION

U.S. Pat. No. 4,921,767, issued to Datta et al., on May 1, 1990, describes the basic method of manufacturing a luminescent screen for a color CRT by an electrophotographic screening (EPS) process, using dry-powdered, triboelectrically-charged screen structure materials that are serially deposited onto a suitable photoreceptor disposed on an interior surface of a faceplate panel. The photoreceptor comprises, preferably, an organic conductive (OC) layer and an overlying OPC layer. U.S. Pat. No. 5,083,959, issued to Datta et al., on Jan. 28, 1992, describes an apparatus for charging the OPC layer of the photoreceptor formed on the interior concave surface of the viewing faceplate. The apparatus includes a corona generator and at least one corona charger having an arcuately shaped charging electrode which is attached to a support arm that is pivotally attached to the apparatus, at a center of curvature of the faceplate panel. The corona charger swings in an arc across the concave interior surface of the faceplate panel to charge the OPC layer, in about 30 to 60 seconds. The relatively long charging time is not a problem in a laboratory environment; however, such a long charging time is incompatible with efficient commercial production, where each step in the EPS process should, ideally, take about 8 to 10 seconds. It is therefore desirable to increase the charging speed by a factor of about three or four, without jeopardizing the uniformity of the charge applied to the OPC layer, or without adding additional charging devices that would increase the manufacturing cost of the CRT.

Applicants have determined that it is not possible to increase the arcuate speed of the charger described in U.S. Pat. No. 5,083,959 without inducing nonuniform charging of the OPC layer. Accordingly, an apparatus utilizing a corona charger having a different configuration is required to obtain the charging speed necessary for commercialization of the EPS process.

SUMMARY OF THE INVENTION

In accordance with the present invention, an apparatus for rapidly and uniformly electrostatically charging a photoconductive layer disposed on a conductive layer provided on an interior concave surface of a viewing faceplate of a CRT faceplate panel is disclosed. The apparatus includes a housing having a faceplate panel support surface, an electrical contact for grounding the conductive layer, a corona charger, and corona charging means. The corona charger includes a charging head that substantially conforms to the contour of the interior concave surface of the viewing faceplate. The charging head comprises a base plate having a mounting surface to which a plurality of discrete charging modules are attached. Each of the charging modules includes a focusing blade and a charging blade insulated from the focusing blade. An ultimate focusing blade is attached to the ultimate discrete charging module. The dimensions of the charging head are slightly less than the interior dimensions of the faceplate panel. The corona charging means includes a first power supply for applying a first voltage to each of the charging blades and a second power supply for applying a second voltage to each of the focusing blades. Reciprocating means are provided for laterally moving the charging head within the faceplate panel for a distance substantially equal to the periodic spacing between charging blades of adjacent discrete charging modules, thereby providing a substantially uniform electrostatic charge to the photoconductive layer on the viewing faceplate.

BRIEF DESCRIPTION OF THE DRAWINGS

The invention will now be described in greater detail, with relation to the accompanying drawings, in which.

DETAILED DESCRIPTION OF THE PREFERRED EMBODIMENTS

Figure 1:
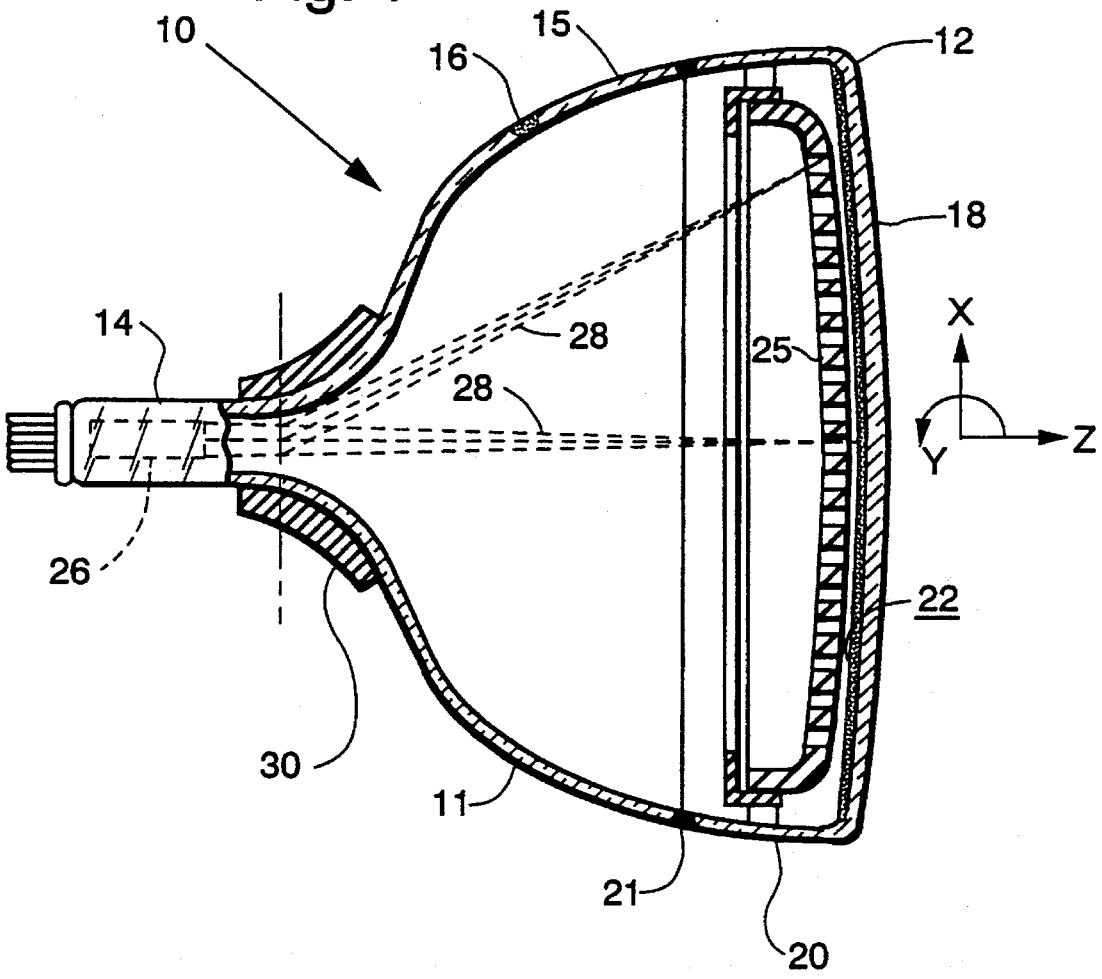
FIG. 1 is a plan view, partially in axial section, of a color CRT made using a charging apparatus of the present invention.
Figure 2:
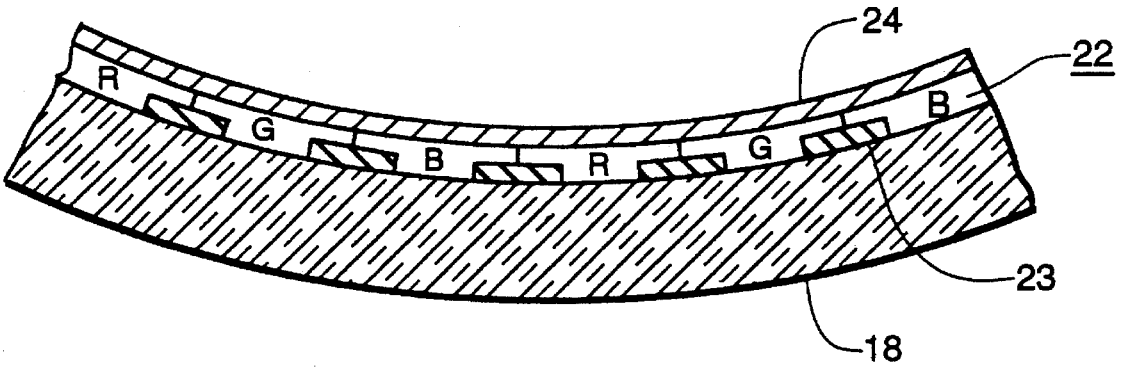
FIG. 2 is a section of a screen assembly of the CRT shown in FIG. 1.

FIG. 1 shows a color CRT 10 having a glass envelope 11 comprising a substantially rectangularly-shaped faceplate panel 12 and a tubular neck 14 connected by a rectangular funnel 15. The funnel has an internal conductive coating (not shown) that contacts an anode button 16 and extends into the neck 14. The panel 12 comprises a viewing faceplate or substrate 18 and a peripheral flange or sidewall 20 which is sealed to the funnel 15 by a glass frit 21. A three color phosphor screen 22 is carried on the inner surface of the viewing faceplate 18. The inner surface contour of the viewing faceplate is concave and may be spherical, cylindrical, or it may have a complex curvature, such as aspheric, for large size faceplate panels. For large size viewing faceplates having an aspheric contour, the radius of curvature along the major axis, x—x, is greater than along the minor axis, y—y. The curvature also may vary along at least the major axis from center to edge. The screen 22, shown in FIG. 2, is a line screen which includes a muliltiplicity of screen elements comprised of red-emitting, green-emitting and blue-emitting phosphor stripes R, G and B, respectively, arranged in color groups or picture elements of three stripes or triads, in a cyclic order. The stripes extend in a direction Which is;generally normal to the plane in which the electron beams are generated. In the normal viewing position of the embodiment, the phosphor stripes extend in the vertical direction. A light absorbing matrix 23 separates adjacent phosphor elements, as is known in the art. Alternatively, the screen may be a dot screen. A thin conductive layer 24, preferably of aluminum, overlies the screen 22 and provides a means for applying a uniform potential to the screen, as well as for reflecting light, emitted from the phosphor elements, through the viewing faceplate 18.

A multi-apertured color selection electrode, such as a shadow mask, 25 is removably mounted, by convention means, within the faceplate panel 12, in predetermined spaced-relation to the screen 22. An electron gun 26, shown schematically by the dashed lines in FIG. 1, is centrally mounted within the neck 14, to generate and direct three electron beams 28 along convergent paths, through the apertures in the mask 25, to the screen 22. The electron gun 26 is conventional and may be any suitable gun known in the art.

The tube 10 is designed to be used with an external magnetic deflection yoke, such as yoke 30, located in the region of the funnel-to-neck junction. When activated, the yoke 30 subjects the three beams 28 to magnetic fields which cause the beams to scan horizontally and vertically, in a rectangular raster, over the semen 22. The initial plane of deflection (at zero deflection) is shown in FIG. 1, at about the middle of the yoke 30. For simplicity, the actual curvatures of the deflection beam paths, in the deflection zone, are not shown.

Figure 5:
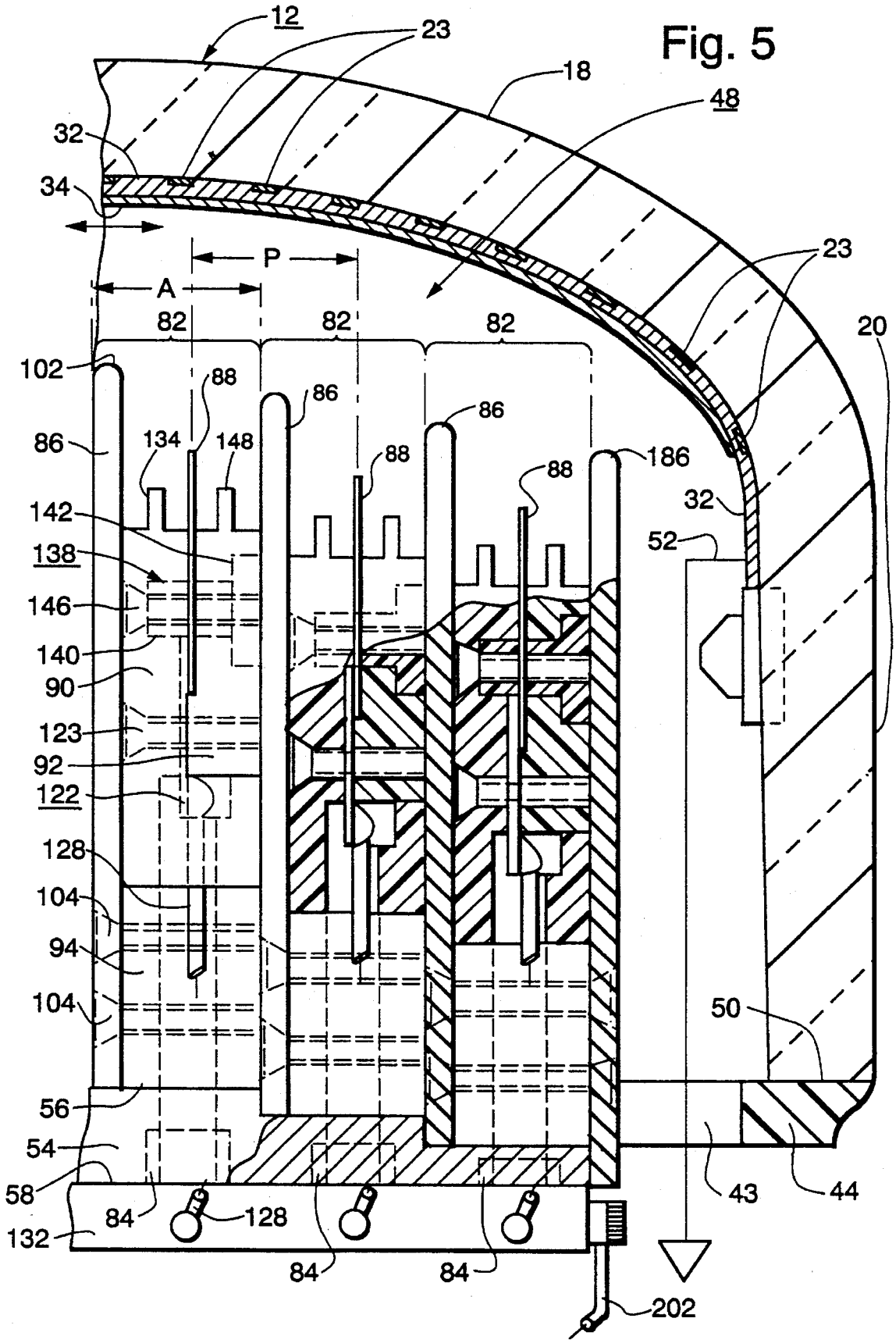
FIG. 5 is an enlarged partial sectional view of the CRT faceplate panel and several discrete charging modules of the charging apparatus within circle 5 of FIG. 3.

The screen is manufactured by an electrophotographic screening (EPS) process that is described in the above-mentioned U.S. Pat. No. 4,921,767. Initially, the panel 12 is cleaned by washing it with a caustic solution, rinsing it in water, etching it with buffered hydrofluoric acid and finishing it again with water, as is known in the art. The interior surface of the viewing faceplate 18 is then provided with the light absorbing matrix 23, for example by using the conventional wet matrix process described in U.S. Pat. No. 3,558,310, issued to Mayaud on Jan. 26, 1971. The interior surface of the faceplate 18, having the matrix 23 thereon, is then coated with a suitable layer 32 of a conductive material which provides an electrode for an overlying photoconductive layer 34. Preferably, both the conductive and the photoconductive layers are made of volatilizable organic materials. The organic conductive (OC) layer 32 and the organic photoconductive (OPC) layer 34 are shown in FIG. 5.

Suitable materials for the OC layer 32 include certain quaternary ammonium polyelectrolytes recited in U.S. Pat. No. 5,370,952, issued on Dec. 6, 1994 to Datta et al. Preferably, the OPC layer 34 is formed by coating the OC layer 32 with a solution containing polystyrene; an electron donor material, such as 1,4-di(2,4-methyl phenyl)-1,4 diphenylbutatriene; electron acceptor materials, such as 2,4,7-trinitro-9-fluorenone and 2-ethylanthroquinone; and a solvent, such as toluene or xylene. A surfactant, such as silicone U-7602 and a plasticizer, such as dioctyl phthalate, also may be added to the solution. The surfactant U-7602 is available from Union Carbide, Danbury Conn.

The OPC layer 34 is rapidly and uniformly electrostatically charged using a novel apparatus 38, shown, for example in FIGS. 3 and 4, and described hereinafter, which charges the OPC layer 34 to a voltage within the range of approximately +200 to +800 volts. The shadow mask 25 is then inserted into the panel 12, which is placed onto a lighthouse, not shown, where the positively charged OPC layer 34 is exposed, through the shadow mask 25, to light from a xenon flash lamp, or other light source of sufficient intensity, such as a mercury are, disposed within the lighthouse. The light which passes through the apertures in the shadow mask 25, at an angle identical to that of one of the electron beams from the electron gun of the CRT, discharges the illuminated areas on the OPC layer 34 on which it is incident, thereby forming a charge image. The shadow mask is removed from the panel 12 and the panel is placed onto a first phosphor developer, also not shown, containing a first color-emitting phosphor material. The first color-emitting phosphor material is positively triboelectrical charged within the developer and directed toward the OPC layer 34. The positively charged first color-emitting phosphor material is repelled by the positively charged areas on the charge image formed on the OPC layer 34 and deposited onto the discharged areas thereof by the process known in the art as "reversal" development. In reversal development, triboelectrically charged particles of screen structure material are repelled by similarly charged areas of the OPC layer 34 and deposited onto the discharged areas thereof. The size of each of the lines of the first color-emitting phosphor is slightly larger than the size of the openings in the light-absorbing matrix 23 to provide complete coverage of each opening, and a slight overlap of the light-absorbing matrix material surrounding the openings. The OPC layer 34 and the phosphor deposited thereon are then recharged using the novel charging apparatus 38 to re-establish a positive voltage on the OPC layer 34 and on the phosphor material. The OPC layer 34 and the phosphor thereon are light exposure and phosphor developed for the second color-emitting phosphor. The steps of recharging, light exposing, and developing are repeated, once again, for the third color-emitting phosphor. The size of each of the lines of the other two color-emitting phosphors on the OPC layer 34 also is larger than the size of the matrix openings, to ensure that no gaps occur and that a slight overlap of the light-absorbing matrix material surrounding the openings is provided.

The three light-emitting phosphors are fixed to the above-described OPC layer 34 by contacting the phosphors with a suitable fixative such as methyl isobutyl ketone (MIBK) which slowly dissolves the polystyrene of the OPC layer 34 to attach the phosphors thereto. The phosphors are then filmed to provide a layer which forms a smooth surface over the screen 22 onto which the evaporated aluminum layer 24 is deposited. The filming may be a conventional emulsion filming, or a dry filming, such as that described in U.S. Pat. No. 5,028,501, issued on Jul. 2, 1991 to Pitt et al. After filming and aluminizing, the screen assembly is baked at a temperature of about 425° C., for about 30 minutes, to drive off the volatilizable constituents of the screen assembly.

Figure 3:
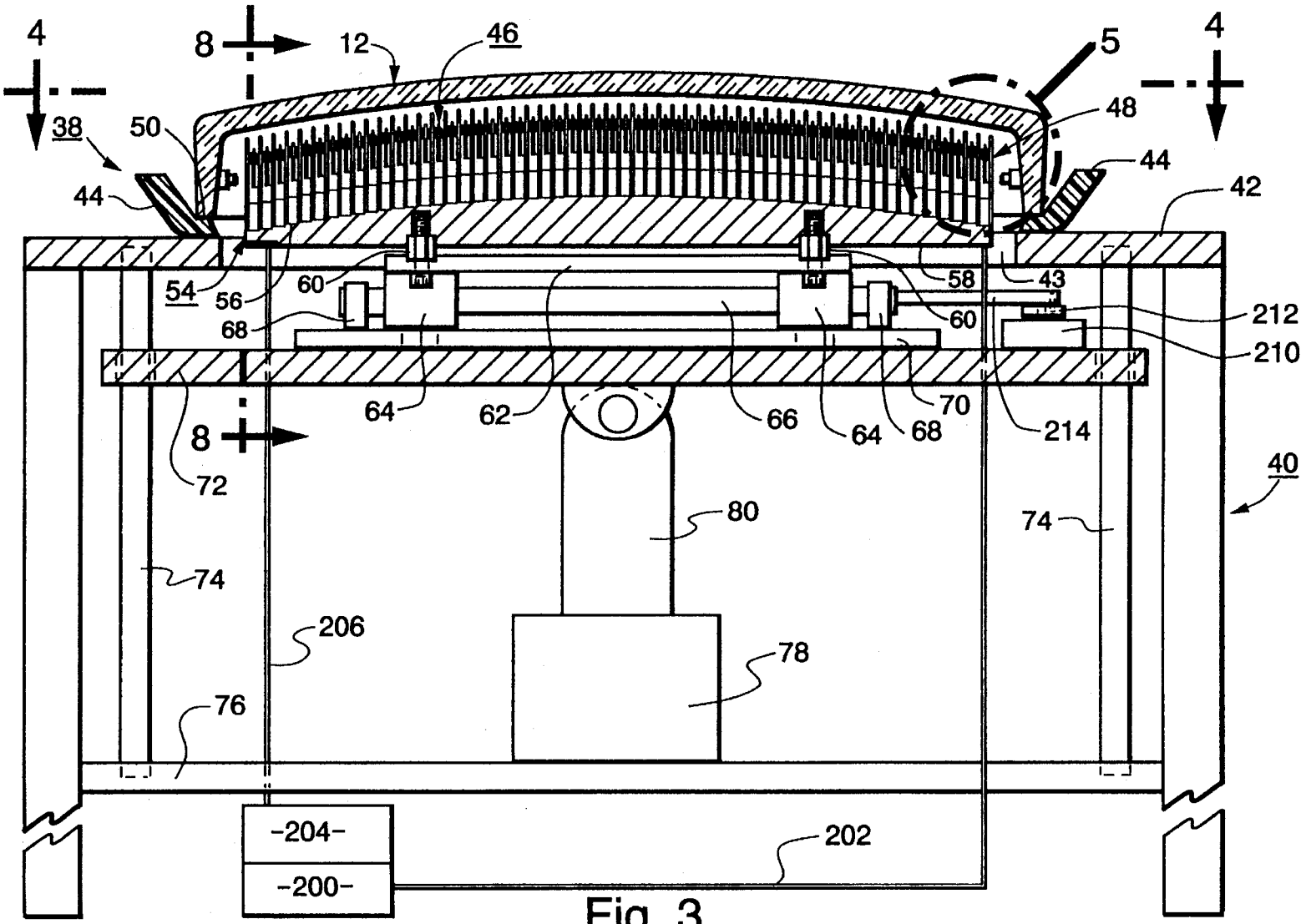
FIG. 3 is a front view of the charging apparatus according to the present invention.
Figure 4:
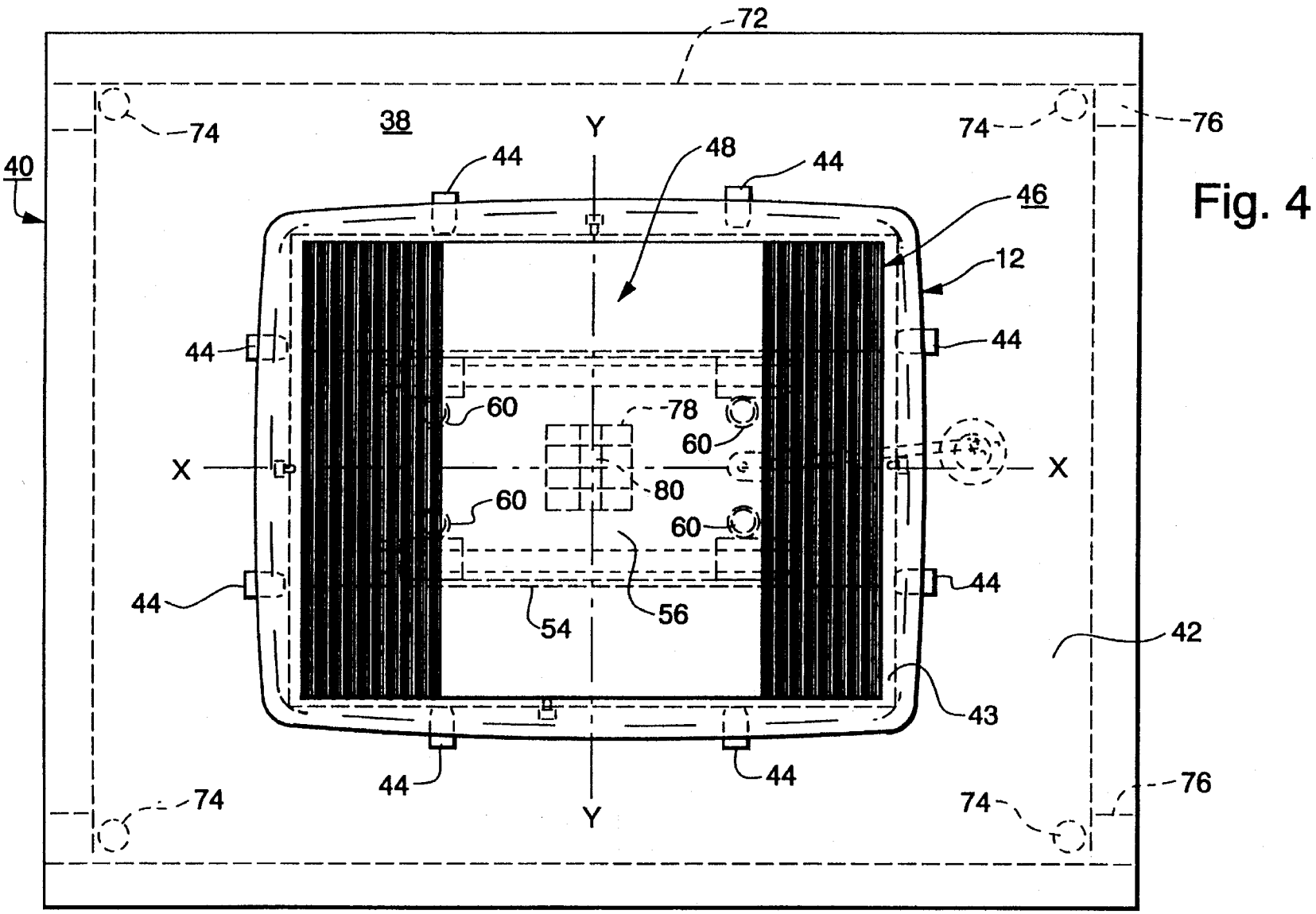
FIG. 4 is a top view of the charging apparatus taken along lines 4—4 of FIG. 3.

With reference to FIGS. 3 and 4, the novel corona charging apparatus 38 includes a housing 40 having a faceplate panel support surface 42 with an opening 43 formed therethrough... A plurality of fixed centering blocks 44 are attached to the faceplate panel support surface 42, around the opening 43, to align the panel 12 with a charging head 46 of a corona charger 48. The blocks 44 are made of a material, such as plastic, that will not chip the sealing edge 50 of the panel 12. Alternatively, moveable centering pads, not shown, that contact the sidewall 20 of the panel 12 may be used to provide alignment with the charging head 46. An electrical contact 52, shown in FIG. 5, is provided to ground the OC layer 32 during the charging operation.

The charging head 46 includes a substantially rectangularly-shaped, conductive base plate 54, shown in FIGS. 3–8 having an obverse mounting surface 56 and a reverse support surface 58. The obverse mounting surface 56 is step-wise continuous and substantially conforms to the contour of the interior surface of the viewing faceplate 18. The reverse surface 58 is flat and is attached by means of four insulative bolts 60 to a carriage 62. The carriage 62 includes slide members 64, shown in FIGS. 3 and 8, that slidingly engage a pair of rods 66 that are supported in end members 68 which are attached to a carriage base 70. The slide members 64 facilitate lateral translation of the carriage 62 and the attached charging head 46 along one axis, such as the major axis, x—x, of the panel 12. The carriage base 70 is secured to a platform 72, shown in FIGS. 3 and 4, that slidingly engages four support posts 74 secured between the faceplate support surface 42 of the housing 40 and an intermediate support 76. Vertical positioning means 78, such as a motor or a pneumatic device, communicates through a connector 80 to the carriage base 70 to permit vertical movement of the charging head 46 through the opening 43 in the support surface 42, so that charging head 46 may be raised and lowered within the faceplate panel 12.

Figure 6:
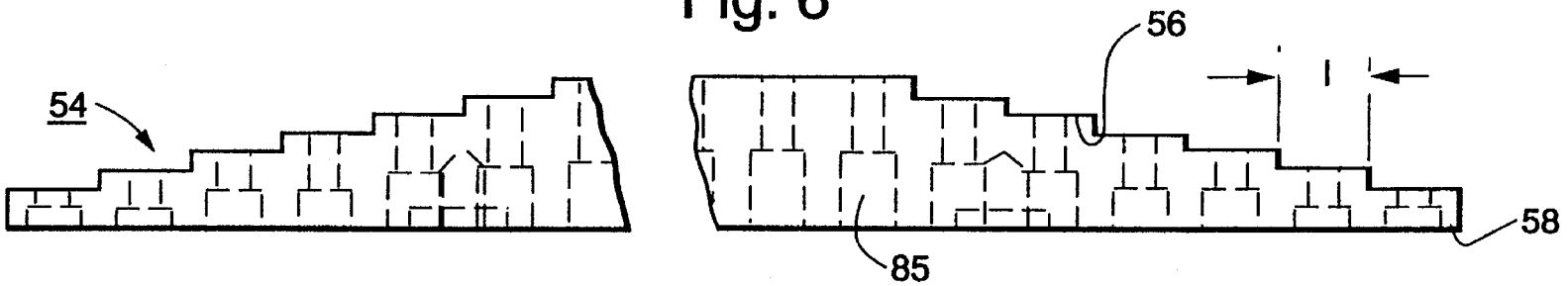
FIG. 6 is a side view of a base plate for the charging apparatus.
Figure 7:
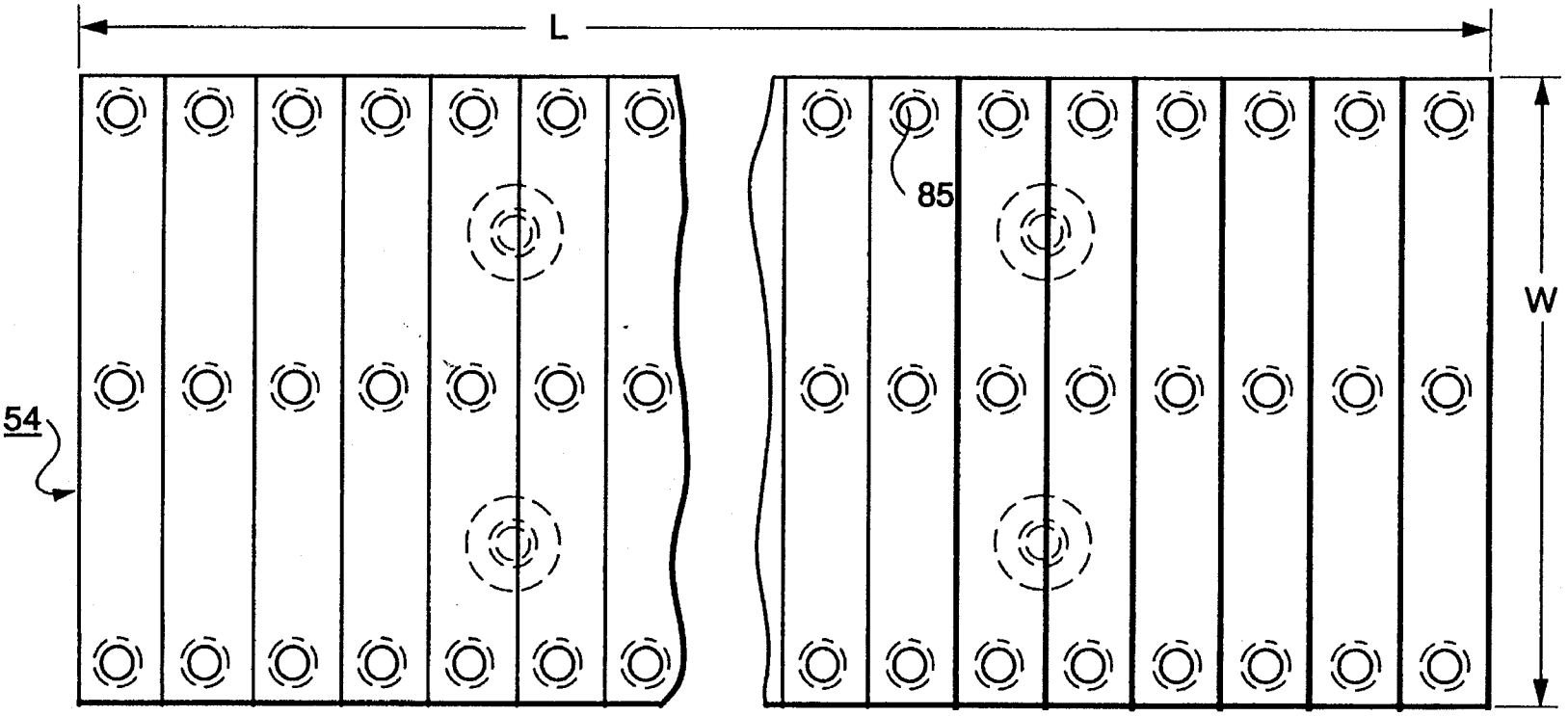
FIG. 7 is a top view of the base plate of FIG. 6.
Figure 8:
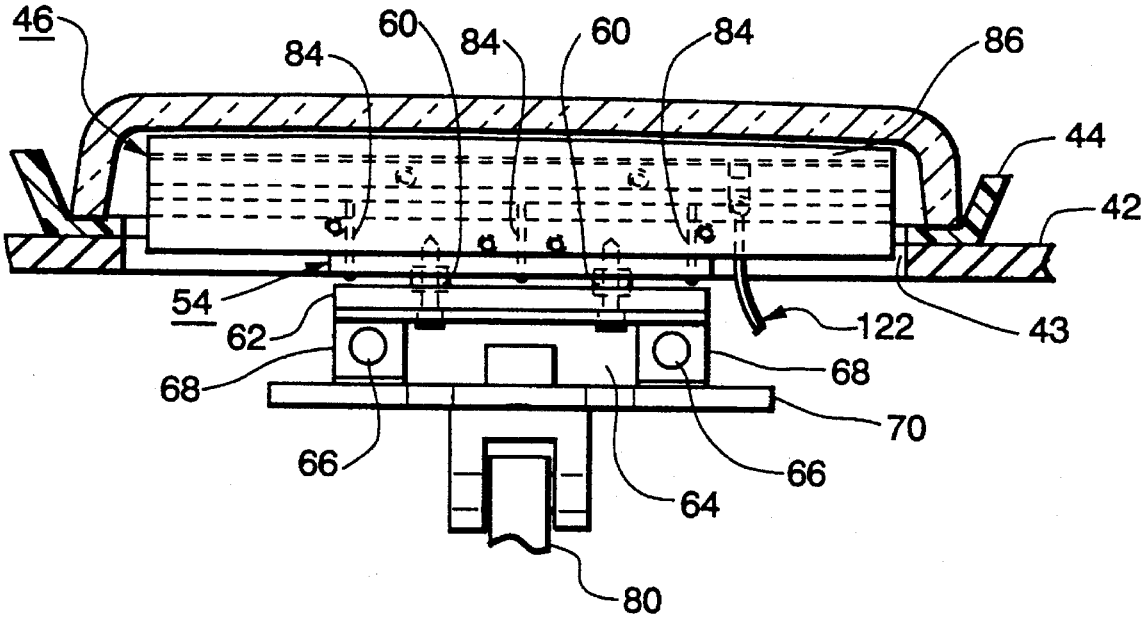
FIG. 8 is a side view taken along line 8—8 of FIG. 3.
Figure 13:
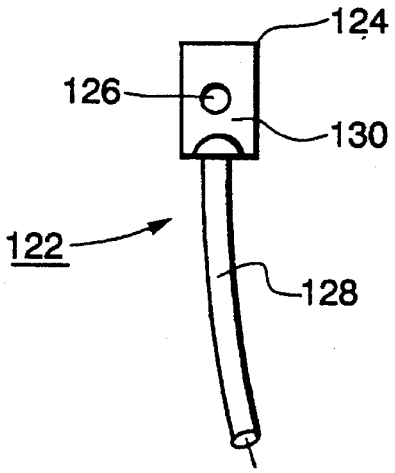
FIG. 13 is a front view of charging blade lead assembly.
Figure 9:
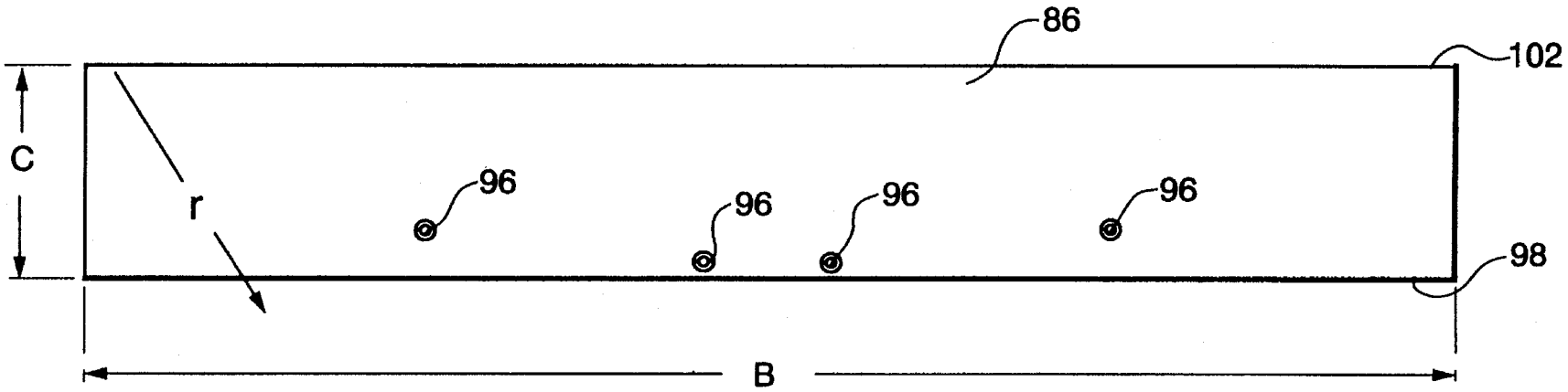
FIG. 9 is a side view of a focusing blade.
Figure 10:
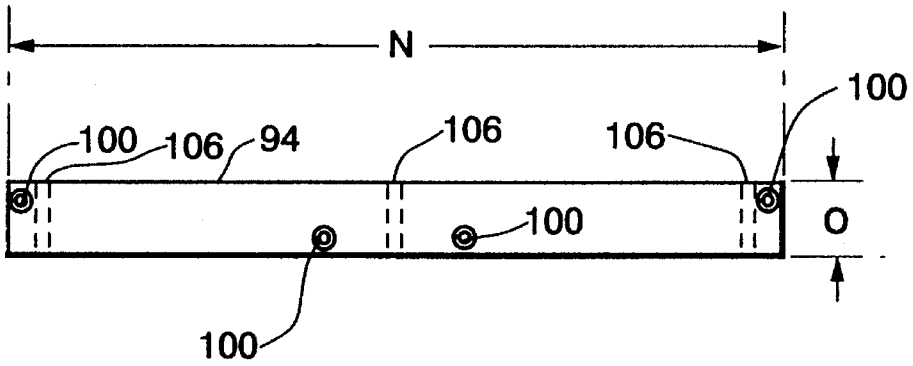
FIG. 10 is a side view of a conductive focusing blade support.

As shown in FIG. 5, the charging head 46 further includes a plurality of substantially identical, discrete charging modules 82 disposed on the mounting surface 56 of the base plate 54 and attached thereto by fastening means 84 which pass through holes 85, shown in FIGS. 6 and 7, drilled through the base plate 54. The holes 85 are counter bored into the fiat reverse surface 58 of the base plate 54. Each charging module 82 includes a conductive focusing blade 86, and a charging blade 88 that is disposed between an "L"-shaped insulative charging blade support 90 and an insulative charging blade clamp 92 that extends along one side of the charging blade 88 and rests upon a portion of the insulative blade support 90. A conductive focusing blade support 94 underlines the charging blade support and abuts the mounting surface 56 of the base plate 54. As shown in FIG. 9, each focusing blade 86 has a plurality of recessed openings 96 formed therethrough adjacent to a fiat proximal end 98 thereof. The openings 96 are countersunk to align with threaded openings 100 provided through the side of the conductive focusing blade support 94, shown in FIG. 10. The distal end 102 of the focusing blade 86 is arcuately shaped and has a radius of curvature, $r_o$, substantially equal to that of the minor axis, y—y, of the faceplate panel 12. In a first preferred embodiment of the invention, to, and the minor axis, y—y, are equal to about 1342.4 cm for a panel 12 having a diagonal dimension of 68 cm (hereinafter referred to as A68). The edge of the distal end 102 is rounded to eliminate sharp edges. Flat head screws 104, shown in FIG. 5, secure the focusing blade 86 to the blade support 94. 18-gauge stainless steel, having a thickness of about 0.12 cm (0.048 in) is the preferred material for the focusing blades 86. Aluminum is preferred material for the focusing blade support 94. Three holes 106 are drilled through the top and bottom surfaces of the blade support 94 to facilitate attachment of the fastening means 84 to the "L"- shaped charging blade support 90. The charging blade support 90 is formed of a machineable insulative material, such as an actal resin, available as DELRIN™, manufactured by E. I. DuPont, Wilmington, Del. The charging blade support 90, shown in FIGS. 11 and 12, includes a first portion 108 and a second portion 110. The first portion 108 rests upon the top surface of the blade support 94 and has three tapped holes 112 through the bottom surface thereof which are aligned with the three holes 106 provided through the top and bottom surfaces of the blade support 94. The fastening means 84, shown in FIG. 8, are secured within the tapped holes 112. An exit lead aperture 114 extends through the bottom surface of the first portion 108 into a lead chamber 116 that includes a substantially narrow recess 118. The narrow recess 118 extends vertically along a segment of the second portion 110 of the charging blade support and communicates with a countersunk charging blade lead hole 120. A charging blade lead assembly 122, shown in FIGS. 5 and 13, is secured within the lead hole 120 by a flat head screw 123. The lead assembly 122, shown in FIG. 13, includes a conductive lug 124 having an opening 126 therethrough to receive the flat head screw 123. A lead 128 is attached at one end, for example by soldering, to one surface 130 of the lug 124. The lead screw 123 passes through the opening 126 and is secured within a threaded hole 13 1, shown in FIG. 14, formed in the side of the insulative blade clamp 92. The other end of the lead 128 is secured to a high voltage lead bus 132, shown in FIG. 5, adjacent to the base 54. Two countersunk charging blade support holes 133 are formed through the side of the second portion 110 of the charging blade support 90. At the top end of the second portion 110 a rectangular projection 134 extends above the main body of the blade support 90. The projection 134 has a radius of curvature, $r_1$, of about 1342.26 cm, whereas the radius of curvature, $r_2$, from the main body portion is about 1342 cm. The projection 134 effectively increases the leakage path length between the charging blade 88 and the focusing blade 86, shown in FIG. 5.

Figure 16:
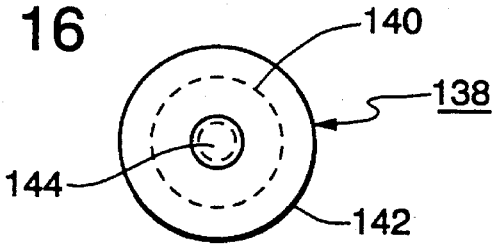
FIG. 16 is a side view of a charging blade insulative retainer.
Figures 11, 12, 14, 15:
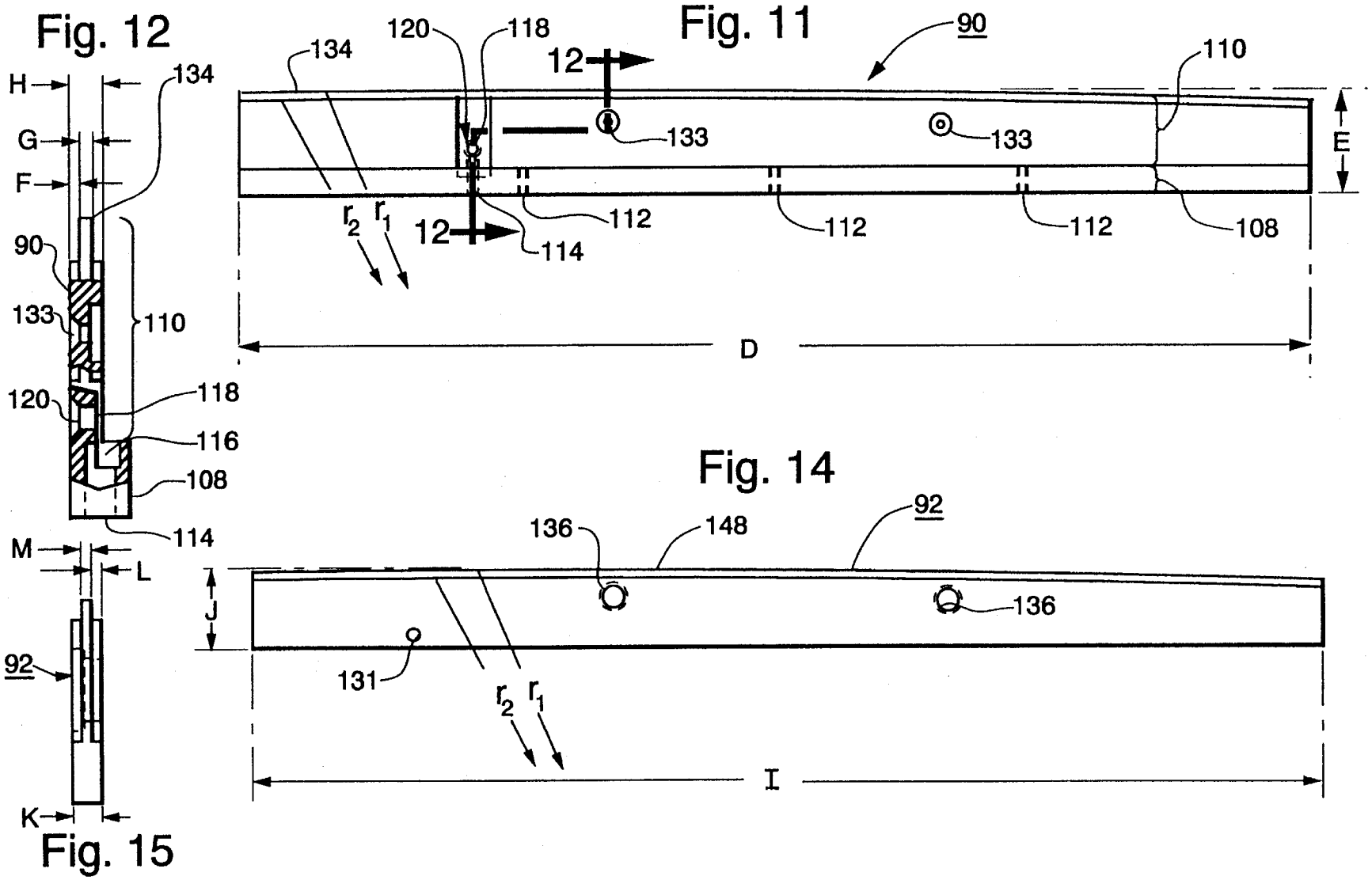
FIG. 11 is a side view of an insulative charging blade support.
FIG. 12 is an enlarged sectional view of the insulative charging blade support of the discrete charging module taken along line 12—12 of FIG. 11.
FIG. 14 is a side view of an insulative charging blade clamp of the discrete charging module.
FIG. 15 is an enlarged end view of the insulative charging blade clamp of FIG. 14.
Figures 17, 18, 19, 20:
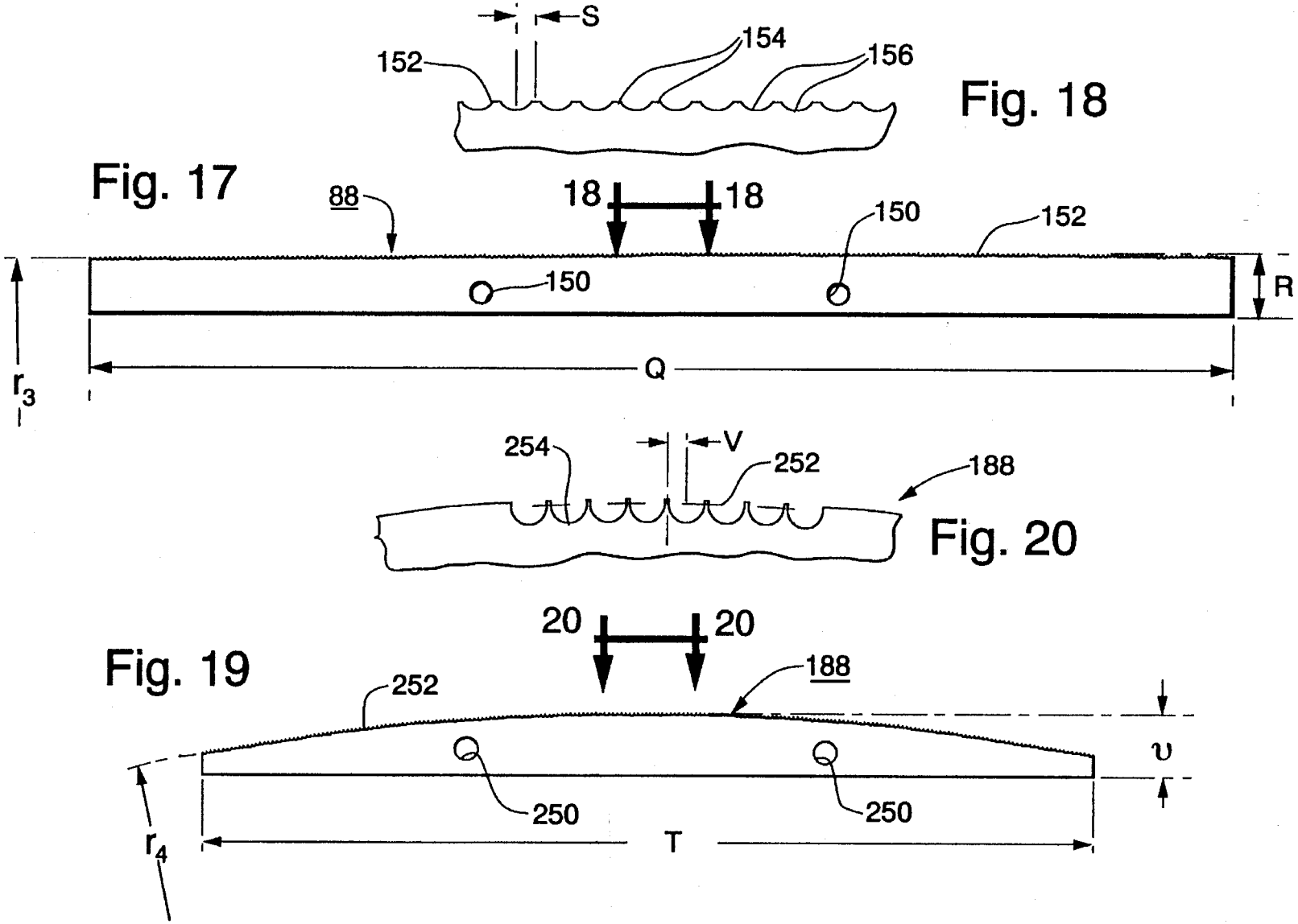
FIG. 17 is a side view of one embodiment of a charging blade.
FIG. 18 is an enlarged view of the serrated edge of the charging blade within area 18—18 of FIG. 17.
FIG. 19 is a side view of a second embodiment of a charging blade.
FIG. 20 is an enlarged view of the serrated edge of the charging blade within area 20—20 of FIG. 19.

The insulative blade clamp 92, shown in FIGS. 14 and 15, also is made of DELRIN™, and is disposed on the top surface of the first portion 108 of the charging blade support 90. Blade securing openings 136 are formed at two locations through the side of the blade clamp 92 to accommodate charging blade insulative retainers 138. As shown in FIGS. 5 and 16, the charging blade retainer 138 comprises a small diameter blade support portion 140 and a larger diameter blade retaining portion 142. A threaded bore 144 extends through the body of the insulative retainer 138 to accept an insulative retaining screw 146 which passes through the countersunk charging blade support holes 133 formed through the side of the second portion 110 of the charging blade support 90. At the top end of the insulative blade damp 92 is a rectangular projection 148, identical to projection 134, is formed in blade support 90. The projection 148 extends above the main body of the blade clamp 92 and effectively increases the leakage path length between the charging blade 88 and the focusing blade 86 of the next adjacent charging module 82. The radius of curvature, $r_1$, of the projection 148 is equal to that of the projection 134, and the radius of curvature, $r_2$, of the main body portion of the blade damp 92 is equal to that of the blade support 90. A charging blade 88, such as that shown in FIGS. 16 and 17 is disposed between the insulative blade clamp 92 and the second portion 110 of the insulative blade support 90 and retained in position by insulative retainers 138 which extend through the two support apertures 150 formed in the charging blade 88 and held in place by the insulative retainer 138 and screws 146, shown in FIG. 5. The charging blade 88 has a thickness of about 0.005 cm is made, preferably, of a nickel-iron ahoy. The radius of curvature, $r_3$, of the blade 88 is about 1341.45 cm. FIG. 18 shows an enlarged view of the arcuately-shaped charging edge 152 of the blade 88. The charging edge 152 includes alternate pairs of first and second serrations, 154 and 156, respectively, which provide a large number of corona points to the chaging blade while maintaining its structural integrity. Each of the first serrations 154 has a radius of about 0.038 cm. Each of the second serrations 156 has a radius of about 0.0648 cm. The center-to-center spacing, S, between each of the adjacent first and second serrations 154 and 156 is about 0.14 cm. As shown in FIG. 5, an ultimate focusing blade 186 is attached to the ultimate discrete charging module 82. The charging blade 88 is positioned about 0.95 cm below the distal end 102 of the focusing blade 86 of the charging module 82.

Typical dimensions for an A68 faceplate panel 12 and the charging apparatus 46 are listed in the TABLE. The column entitled "Figure" refers to the Figure showing the most appropriate view of the component. All dimensions are in centimeters.

TABLE

| Component | FIG. | Dimension |
|---|---|---|
| Interior major axis, x—x | 4 | 55.5 |
| Interior minor axis, y—y | 4 | 42.5 |
| 82, A | 5 | 0.914 |
| 54, 1 | 6 | 0.914 |
| 54, L | 7 | 52.39 |
| 54, W | 7 | 20.96 |
| 86, B | 9 | 40.64 |
| 86, C | 9 | 6.47 |
| 90, D | 11 | 40.64 |
| 90, E | 11 | 3.46 |
| 90, F | 12 | 0.12 |
| 90, G | 12 | 0.15 |
| 90, H | 12 | 0.04 |
| 92, I | 14 | 40.64 |
| 92, J | 14 | 2.44 |
| 92, K | 15 | 0.40 |
| 92, L | 15 | 0.12 |
| 92, M | 15 | 0.15 |
| 94, N | 10 | 20.96 |
| 94, O | 10 | 1.91 |
| Period, P | 5 | 0.914 |
| 88, Q | 17 | 40.51 |
| 88, R | 17 | 2.1 |
| 154–156, S | 18 | 0.14 |

Again with reference to FIG. 3, the present charging apparatus 38 includes a first high voltage power supply 200 connected by lead 202 to the lead bus 132, shown in FIG. 5, which applies the first high voltage of about 5 kV to the charging blades 88. A second high voltage power supply 204 is connected by lead 206 to the base plate 54 which is electrically connected to the focusing blades 86, 186 and applies a second high voltage of about 1 kV thereto.

In the operation of the charger 38, a faceplate panel 12 is positioned on the support surface 43 of the housing 40. The panel 12 is centered on the support surface and aligned with the charger head 48 which is raised into proximity with the OPC layer 34, disposed on the interior surface of the viewing faceplate 18, by the vertical positioning means 78. Typically, the focusing blades 86, 186 of the charger head 46 are vertically spaced about 12.5 cm from the interior surface of the viewing faceplate 18 when the charger head is raised into the charging position. The high voltage power supplies 200 and 204 are activated while the charging head 46 is moved laterally in the direction of the major axis, x—x, by a head translating motor 210 having an eccentric cam 212 connected thereto. A shaft 214 is connected between the eccentric cam 212 and the carriage 62 to provide reciprocating, or lateral, movement to the charging head 46. Alternatively, pneumatic cylinders, not shown, may be connected to the carriage 62 to provide reciprocating movement to the charging head 46. As shown in FIG. 5, the charging head 46 moves back and forth only about 0.914 cm, or one period, P, which is the distance, or periodic spacing, between charging blades 88 of adjacent charging modules 82. This small motion is sufficient to rapidly and uniformly charge the OPC layer 34 to the desired voltage. The voltage provided to the OPC layer 34 is dependent not only on the charging time, but also on the voltages supplied to the charging blades 88 and the focusing blades 86, 186. The potential on the focusing blades directs, or focuses, the corona discharge towards the OPC layer 34 and limits the maximum voltage that can be provided to the OPC layer. Additionally, the vertical spacing between the charging head 46 and the interior surface of the viewing faceplate 18 determines whether or not any charge is applied to the OPC layer 34 on the sidewall of the panel 12, it has been determined that the charging apparatus 38 charges the OPC layer 34 to a voltage of about +800 volts in about 8 seconds, thus making the present charger suitable for production processing.

A second embodiment of a corona charging blade 188 for an A51 faceplate panel, i.e., a faceplate panel having a diagonal dimension of 51 cm, is shown in FIGS.. 19 and 20. The blade 188 also has a thickness of about 0.005 cm and is made, preferably, of a iron-nickel alloy. The radius of curvature, $r_4$, of the blade 188 is about 82.79 cm, and the radius of curvature of the interior surface of the A51 faceplate panel along the minor axis, y—y, is about 83.75 cm. As shown in FIG. 19, the length, T, of the blade 188 is about 31.45 cm, and the height, U, is about 2.05 cm. Two support apertures 250 are formed in the blade 188 to accommodate the insulative retainers 138. FIG. 20 shows an enlarged view of the arcuately-shaped charging edge 252 of the blade 188. The charging edge 252 includes a multiplicity of serrations 254, each having a radius of about 0.0635 cm and a center-to-center spacing, V, between adjacent serrations of about 0.14 cm. The blade 188 would be disposed within a discrete charging module similar to the charging module 82 and would include a focusing blade, an insulative charging blade support, and an insulative charging blade clamp similar to the focusing blade 86, the blade support 90 and the blade clamp 92 described above, but differing only in radii of curvature and height. The length along the minor axis, y—y, of each of these components is about 30.48 cm for an A51 faceplate panel. The parameters of radius of curvature and height also are scaled to take into consideration the different radius of curvature and interior dimensions of the A51 faceplate panel. The base plate used for a charging apparatus designed for an A51 faceplate would be similar to base plate 54, but would differ only in the contour of the mounting surface and length of the base plate along the major axis x—x. Each charging module for the A51 charging head would have the same lateral dimensions as the charging module 82 for the A68 faceplate panel.

What is claimed is:

1. In an apparatus for rapidly and uniformly charging a photoconductive layer disposed on a conductive layer provided on an interior concave surface of a viewing faceplate of a CRT faceplate panel including: a housing having a faceplate panel support surface; an electrical contact for grounding said conductive layer; a corona charger; and corona charging means, the improvement comprising a) said corona charger including a charging head substantially conforming to the contour of said interior concave surface of said viewing faceplate, said charging head comprising a base plate having a mounting surface to which a plurality of discrete charging modules are attached, each of said charging modules including a focusing blade and a charging blade insulated from said focusing blade, an ultimate focusing blade being attached to the ultimate discrete charging module, the dimensions of said charging head being slightly less than the interior dimensions of said faceplate panel, b) said corona charging means including a first power supply for applying a first voltage to each of said charging blades, and a second power supply for applying a second voltage to each of said focusing blades, and c) reciprocating means for laterally moving said charging head within said faceplate panel for a distance substantially equal to the periodic spacing between charging blades of adjacent discrete charging modules, thereby providing a substantially uniform electrostatic charge to said photoconductive layer on said viewing faceplate.

2. The apparatus as described in claim 1, further including vertical positioning means for raising and lowering said charging head within said faceplate panel.

3. The apparatus as described in claim 2, wherein the vertical spacing between the interior surface of said viewing faceplate and the focusing blades in about 12.5 cm (0.5 in) when said charging head is raised to the charging position.

4. The apparatus as described in claim 3, wherein each of said focusing blades has a smooth, arcuately-shaped focusing edge.

5. The apparatus as described in claim 1, wherein said mounting surface of said base plate is step-wise continuous and substantially conforms to the contour of the interior surface of said viewing faceplate.

6. The apparatus as described in claim 1, further including centering means affixed to said faceplate panel support surface of said housing to align said faceplate panel with said charging head.

7. The apparatus as described in claim 1, wherein said first voltage is about 5 kV and said second voltage is about 1 kV.

8. The apparatus as described in claim 1, wherein the periodic spacing between adjacent charging blades is about 0.914 cm.

9. The apparatus as described in claim 1, wherein each of said charging blades has an acruately-shaped charging edge with a multiplicity of serrations formed therein.

10. The apparatus as described in claim 9, wherein said charging edge of each of said charging blades has alternate pairs of first and second serrations.

11. The apparatus as described in claim 10, wherein each of said first serrations has a radius of about 0.038 cm, and each of said second serrations has a radius of about 0.0648, the center-to-spacing between each of said adjacent pairs of first and second serrations is about 0.14 cm.

12. The apparatus as described in claim 9, wherein each of said serrations is substantially identical, with a radius of about 0.0635 cm and center-to-center spacing of about 0.14 cm.

13. In an apparatus for rapidly and uniformly charging an organic photoconductive layer disposed on an organic conductive layer provided on an interior concave surface of a viewing faceplate of a substantially rectangularly-shaped CRT faceplate panel during electrophotographic screen processing, said panel having two long sides and two short sides, said panel including a major axis which parallels said long sides and a minor axis which parallels said short sides, said apparatus including: a housing having a faceplate panel support surface; an electrical contact for grounding said conductive layer; a corona charger; and corona charging means, the improvement comprising a) said corona charger including a charging head having a charging surface that substantially conforms to the contour of said interior concave surface of said viewing faceplate, said charging head having two long sides and two short sides, said charging head having a major axis which coincides with the major axis of said panel and a minor axis which coincides with the minor axis of said panel, said charging head including a substantially rectangularly-shaped base plate having a mounting surface that is step-wise continuous and substantially conforms to the contour of the interior surface of said viewing faceplate, a plurality of discrete, substantially identical, charging modules detachably attached to said mounting surface of said base plate, each of said charging modules comprising a focusing blade and a charging blade insulated from said focusing blade, an ultimate focusing blade being attached to the ultimate discrete charging module to form said charging head, said charging blades and said focusing blades extending along one of said axes of said charging head, the long sides of said charging head being slightly less than the interior dimension of the long sides of said faceplate panel, and the short sides of said charging head being slightly less than the interior dimension of the short sides of said panel, said base plate also having a reverse surface that is insulatively attached to a carriage, b) said corona charging means including a first power supply for applying a first voltage to each of said charging blades, and a second power supply for applying a second voltage to each of said focusing blades, and c) a shaft connected between a motor-driven eccentric cam and said carriage for laterally moving said charging head aiong one of said axes of said panel, the lateral movement being for a distance substantially equal to the periodic spacing between charging blades of adjacent discrete charging modules, thereby providing a substantially uniform electrostatic charge to said photoconductive layer on said faceplate panel.

14. The apparatus as described in claim 13, further including vertical positioning means communicating with a carriage base for vertically raising and lowering said charging head within said faceplate panel.

15. The apparatus as described in claim 14, wherein the vertical spacing between the interior surface of said faceplate panel and the focusing blades is about 12.5 cm (0.5 in) when said charging head is raised to the charging position.

16. The apparatus as described in claim 15, wherein each of said focusing blades has a smooth, arcuately-shaped focusing edge.

17. The apparatus as described in claim 13, further including centering means affixed to said faceplate panel support surface of said housing to align said faceplate panel with said charging head.

18. The apparatus as described in claim 13, wherein said first voltage is about 5 kV and said second voltage is about 1 kV.

19. The apparatus as described in claim 13, wherein the periodic spacing between charging blades of adjacent discrete charging modules is about 0.914 cm.

20. The apparatus as described in claim 13, wherein each of said charging blades has an acruately-shaped charging edge with a multiplicity of serrations formed therein.

21. The apparatus as described in claim 20, wherein said charging edge of each of said charging blades has alternate pairs of first and second serrations.

22. The apparatus as described in claim 21, wherein each of said first serrations has a radius of about 0.038 cm, and each of said second serrations has a radius of about 0.0648, the center-to-spacing between each of said adjacent pairs of first and second serrations is about 0.14 cm.

23. The apparatus as described in claim 20, wherein each of said serrations is substantially identical, with a radius of about 0.0635 cm and center-to-center spacing of about 0.14 cm.

* * * * *